US005801631A

United States Patent [19]

Hayashi

[11] Patent Number: 5,801,631

[45] Date of Patent: Sep. 1, 1998

[54] THEFT CHECKING SYSTEM

[75] Inventor: Michinari Hayashi, Nisshin, Japan

[73] Assignee: Maspro Denkoh Co., Ltd., Nisshin, Japan

[21] Appl. No.: 836,117

[22] PCT Filed: Aug. 22, 1996

[86] PCT No.: PCT/JP96/02349

§ 371 Date: Apr. 21, 1997

§ 102(e) Date: Apr. 21, 1997

[87] PCT Pub. No.: WO97/08671

PCT Pub. Date: Mar. 6, 1997

[30] Foreign Application Priority Data

Aug. 23, 1995 [JP] Japan ..... 7-214972

[51] Int. Cl.[6] ..... G08B 13/14

[52] U.S. Cl. ..... 340/572; 340/551

[58] Field of Search ..... 340/572, 551; 343/742; 327/72

[56] References Cited

U.S. PATENT DOCUMENTS

| | | | |
|---|---|---|---|
| 4,859,991 | 8/1989 | Watkins et al. | 340/572 |
| 5,264,829 | 11/1993 | Paul et al. | 340/572 |
| 5,353,011 | 10/1994 | Wheeler et al. | 340/572 |
| 5,414,410 | 5/1995 | Davies et al. | 340/551 |

FOREIGN PATENT DOCUMENTS

| | | |
|---|---|---|
| 63-126094 | 5/1988 | Japan . |
| 4-120691 | 4/1992 | Japan . |
| 6-139467 | 5/1994 | Japan . |
| 6-209270 | 7/1994 | Japan . |

*Primary Examiner*—Jeffrey A. Hofsass
*Assistant Examiner*—John Tweel, Jr.
*Attorney, Agent, or Firm*—Pearson & Pearson

[57] ABSTRACT

A theft checking system that improves precision in detecting a tag and prevents false notification. A first computer (S3) samples a waveform in a fixed length of time of a signal received by a reception antenna. A digital direct synthesizer (S4) divides the sampled waveform data of the fixed length of time and a reference signal pre-registered in a memory circuit of a calculating portion respectively into portions by equal pitch with respect to the time axis, multiplies the value of the reference signal at each point separately by the value at each point in the data corresponding to that point, and calculates the sum of the products. A matching circuit (S6) compares the calculated value with a predetermined value to detect a waveform that agrees with the reference oscillation. A tag (S7) actuates notifying means.

4 Claims, 7 Drawing Sheets

THEFT CHECKING SYSTEM

TECHNICAL FIELD

The present invention relates to a theft checking system wherein a tag incorporating a resonance circuit is attached to an article and, if the tagged article passes between transmission and reception antennas disposed facing each other, the resonance circuit picks up electromagnetic waves transmitted from the transmission antenna and undergoes resonance, so that the resonance circuit reradiates resonance electromagnetic waves, and the reception antenna receives the resonance electromagnetic waves, thereby detecting passage of the tagged article.

BACKGROUND ART

The theft checking system uses a short wave band around, for example, 8.2 MHz. Such band is subject to intrusion as noises of communication signals, electromagnetic waves from fluorescent lamps or office automation appliances, or thermal noises, and the electromagnetic waves radiated from the transmission antenna is weak. Thus, the signal detection conditions of the resonance electromagnetic waves are extremely bad.

For a reduction of the influence of noises, increasing the electromagnetic wave transmission power, increasing the resonance circuit in size, or reducing the detection area can be considered. However, an increase in the electromagnetic wave transmission power is only permitted within a limit, and a size increase of the resonance circuit results in a correspondingly increased size of the tag, which offends the eye and is unfavorable.

A reduction of the detection area is difficult to realize because it disagrees with the demand for enlarged detection areas.

Accordingly, conventional technologies are proposed, as described in, for example, Japanese Patent Laid-Open No. Sho 61-118897, wherein the threshold level setting is variable corresponding to the noise level, and only waveforms exceeding the threshold level are regarded as valid detection signals, or Japanese Patent Publication No. Sho 63-1216094, wherein two types of resonance circuits having different resonance frequencies are incorporated in a tag, and the electromagnetic waves to be transmitted are subjected to sweeping, and if the re-radiated electromagnetic waves are received four times every period of sweep, validity is established and a detection signal is outputted.

The former technology is not only incapable of detection if the level of resonance electromagnetic waves is low, but also mistakenly detects as a resonance signal a noise having a pulse-like sharp amplitude change when the power is thrown in. Thus, the detection precision cannot be said to be high. Although the latter technology achieves a high detection precision since it detects only clear re-radiated electromagnetic waves while ignoring eruptive noises that occur in a period, the tag doubles in size and becomes bulky, thus standing out in appearance.

Moreover, although either technology passes received electromagnetic waves through a band-pass filter corresponding to the frequency of the resonance signal to emphasize the waveform, both technology lack a function of distinguishing resonance signals from noises. Therefore, with short-wave broadcasting or CW jamming waves as for example, either technology is unable to determine whether a waveform is of a resonance signal or of a noise, regardless whether the waveform is a waveform as received (FIG. 7*a*) or a waveform obtained by passing the received waveform through a band-pass filter to remove unneeded electromagnetic waves FIG. 7*b*). Thus, the cause for errors still remain.

[Disclosure of the Invention]

The present invention is a checking system that improves detection precision and reduces the possibility of errors to a minimum level. The system features a construction comprising analysis means for causing a transmission antenna to output electromagnetic waves of a constant amplitude in which periodical sweep is made between predetermined frequencies, and for extracting a signal that substantially agrees with the period of a model waveform of re-radiated electromagnetic waves pre-registered as a reference signal, from the signals received by a reception antenna, and for comparing its waveform with a predetermined value to recognize passage of the article.

The waveform that agrees with the reference signal may be detected by sampling a waveform from a received signal in a fixed length of time, dividing the sampled waveform data of the fixed length of time and the registered reference signal respectively into portions by equal pitch with respect to the time axis, multiplying the value of the reference signal at each point separately by the data corresponding to that point, calculating the sum of the products, and comparing the calculated value with a predetermined value. The comparison between the calculated value and the predetermined value may be performed collectively with respect to results obtained by repeated operations in which the reference signal is shifted one point at a time relative to the sampled waveform of the fixed length of time.

The analysis means may employ a technology that uses a band-pass filter to remove noises outside the band from the received signals and then performs A–D conversion and digital processing of the filtered signals.

The predetermined value herein refers to a limit value for determination as to whether a signal has a waveform transmitted from a tag, and the fixed length of time refers to a duration (time) of the reference waveform.

[Brief Description of the Invention]

Figure 3A:
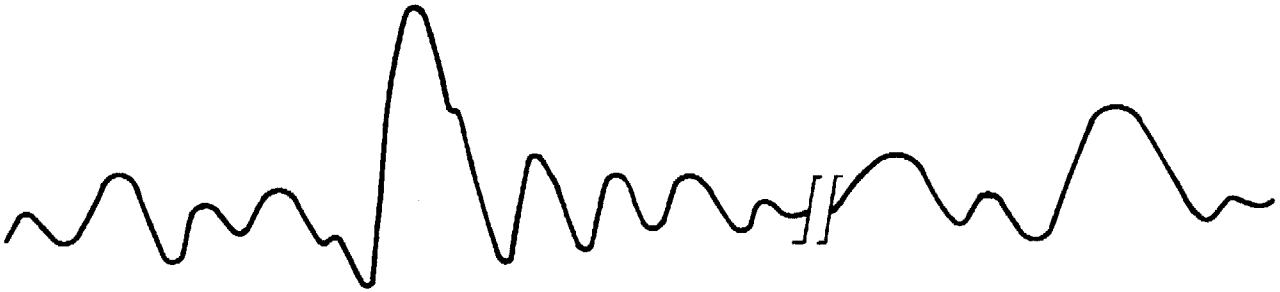
Figure 3B:
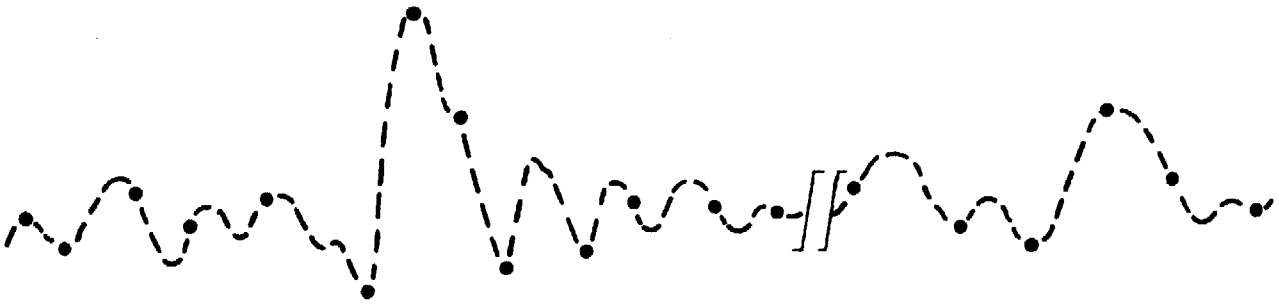

FIGS. 3*a* and 3*b* are diagrams illustrating an example of the sampling of a received signal.

Figure 4:
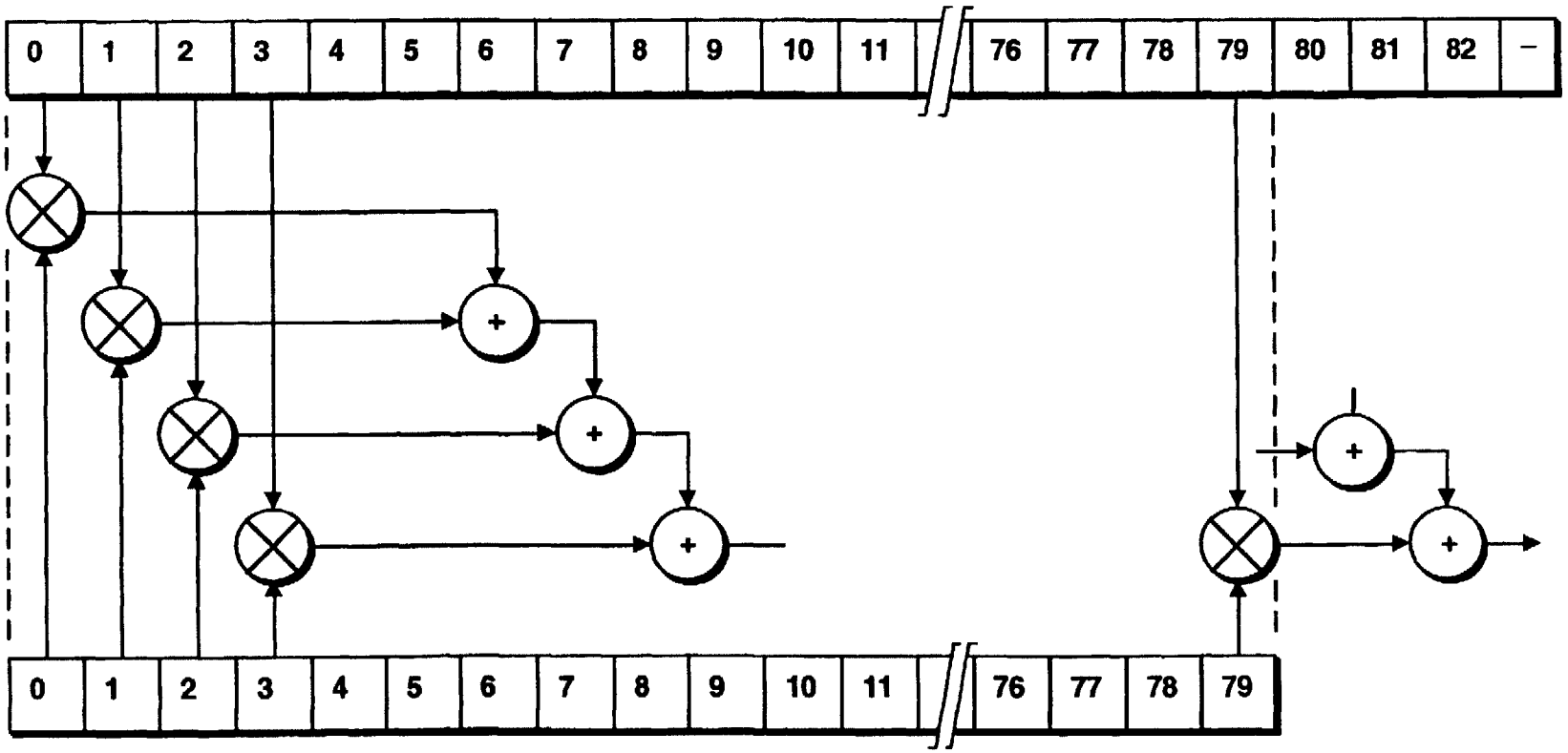

FIG. 4 is a diagram illustrating the calculation processing.

Figure 5A:
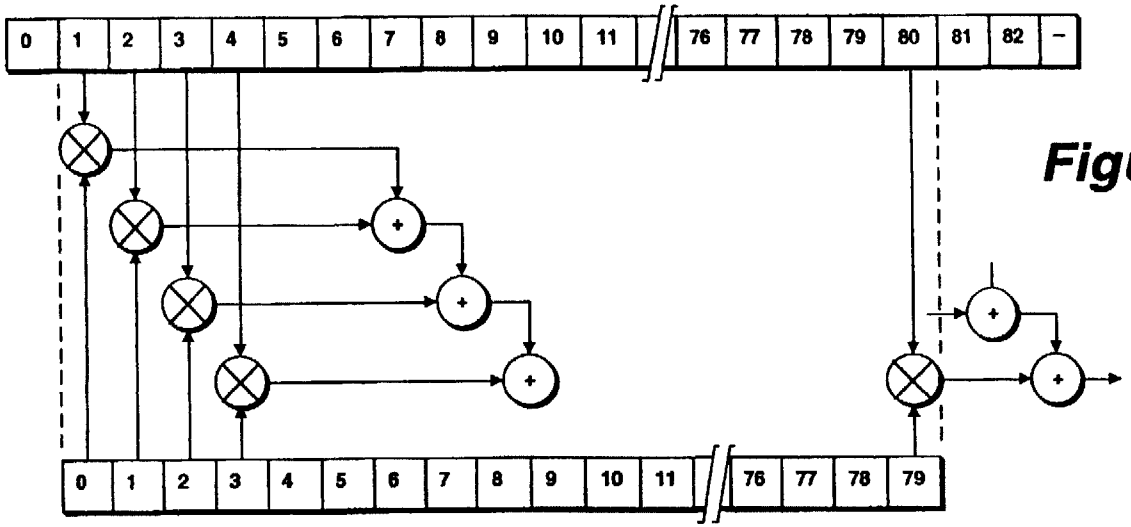
Figure 5B:
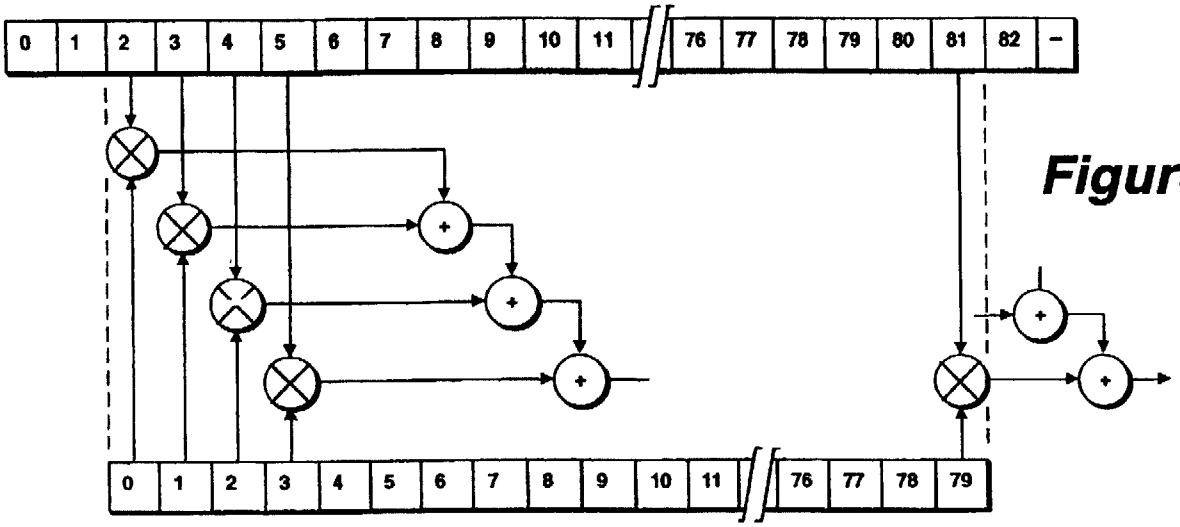

FIGS. 5*a* and 5*b* are diagrams illustrating the calculation processing.

Figure 6:
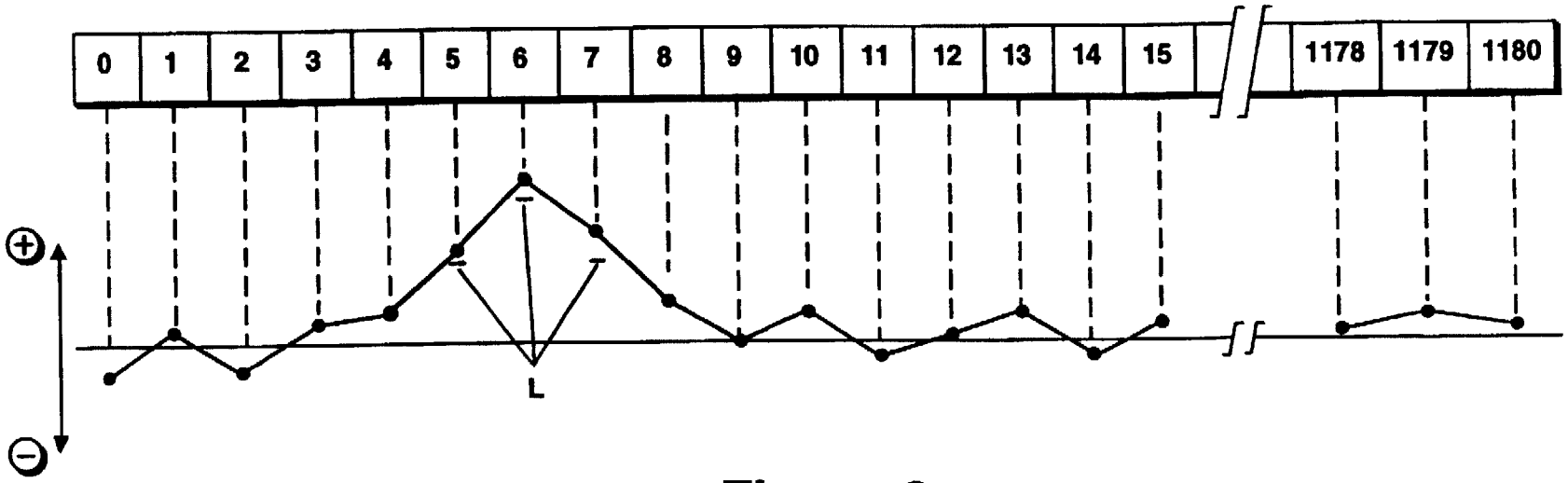

FIG. 6 is a diagram illustrating an example of detection.

Figure 7A:
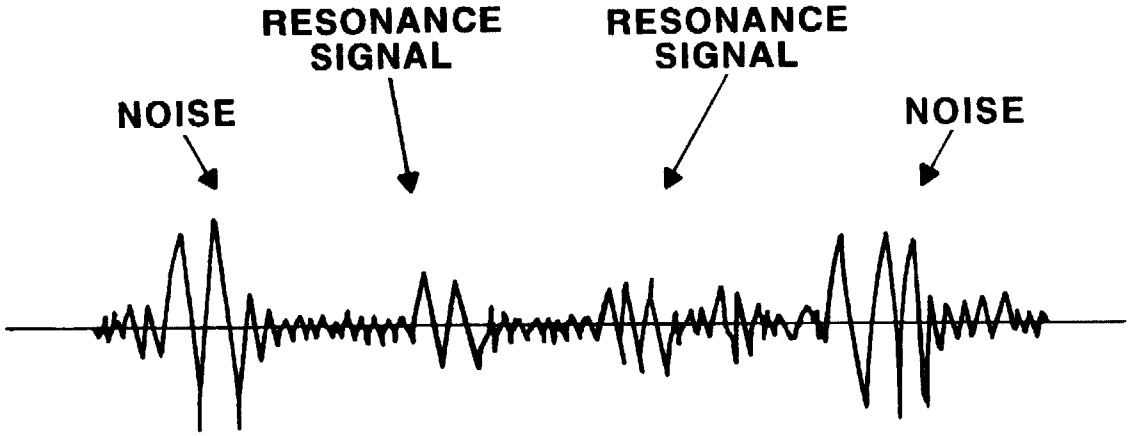
Figure 7a (PRIOR ART)
Figure 7B:
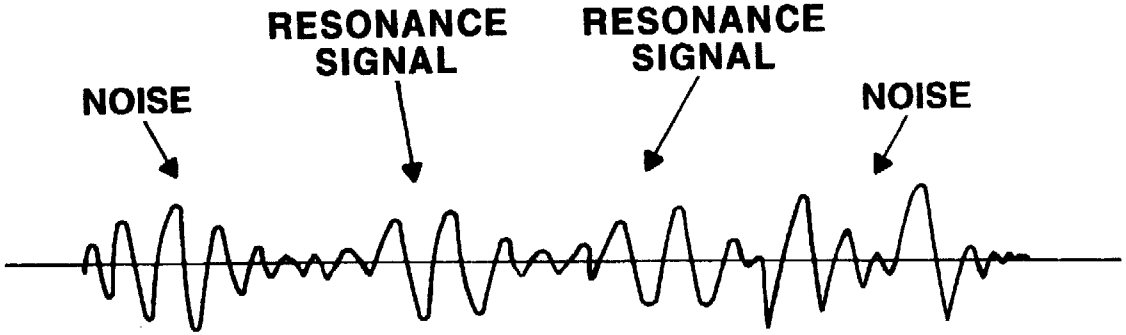
Figure 7b (PRIOR ART)

FIG. 7*a* and 7*b* are diagrams illustrating a conventional art.

[Best Mode for Carrying Out the Invention]

An embodiment of a theft checking apparatus according to the present invention will be described with reference to the drawings.

Figure 1:
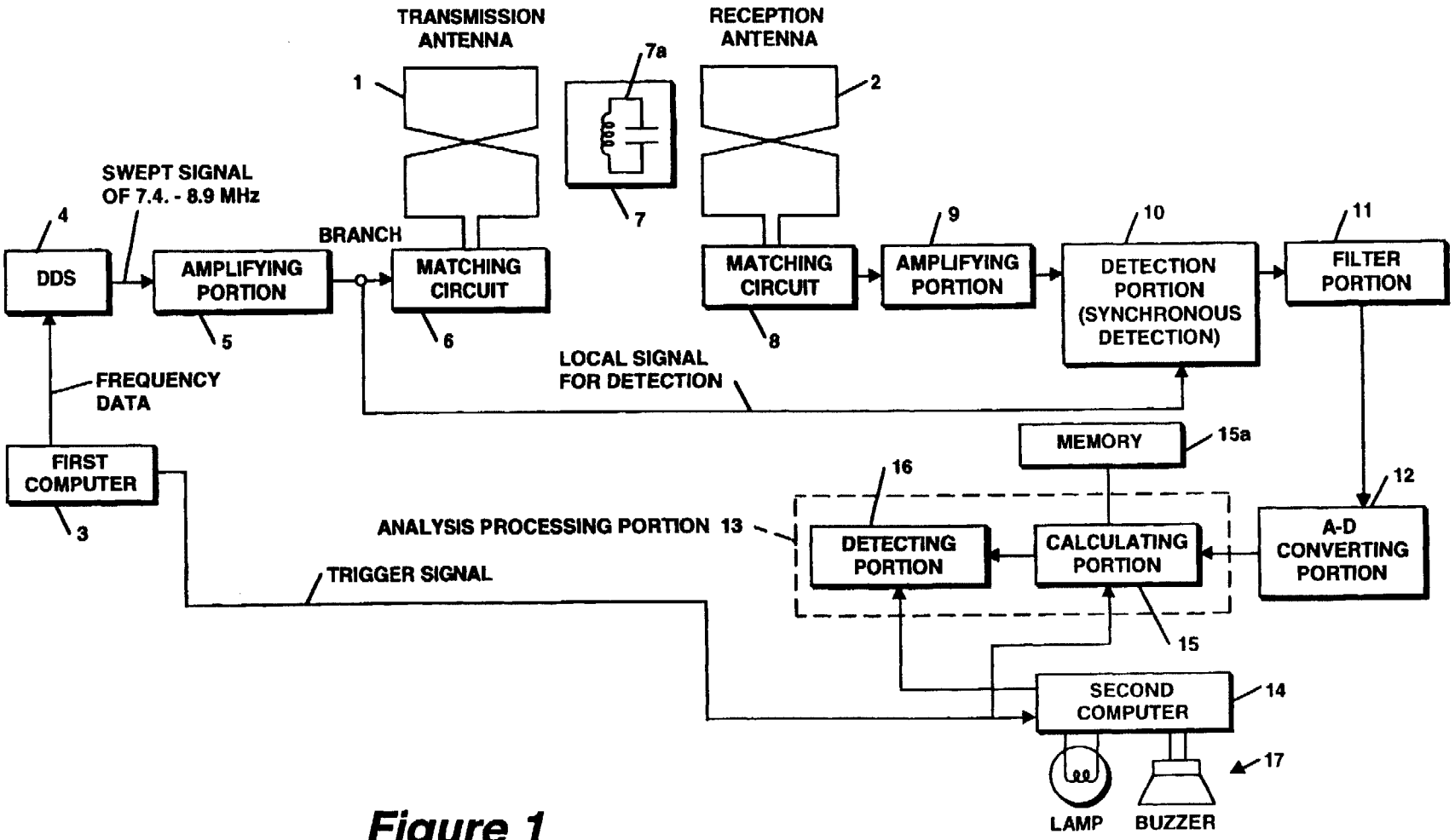
FIG. 1 is a block diagram illustrating a theft checking system according to the present invention.

FIG. 1 is a block diagram of a theft checking apparatus, wherein 1 represents a transmission antenna, 2 represents a reception antenna, each of which is a loop type in which a central portion is crossed once.

In accordance with the frequency data inputted in a first computer 3, a signal of a constant amplitude in which periodic sweep is made across a HF band of 7.4 MHz–8.9 MHz is outputted from a DDS (digital direct synthesizer) 4 and inputted through an amplifying portion 5 and a matching circuit 6 to a transmission antenna 1, which thereby outputs electromagnetic waves.

On the other hand, the reception antenna 2 receives electromagnetic waves outputted from the transmission antenna and, further, electromagnetic waves re-radiated from a resonance circuit 7*a* contained in a tag 7 that passes between the transmission and reception antenna, together with noises.

Figure 2:
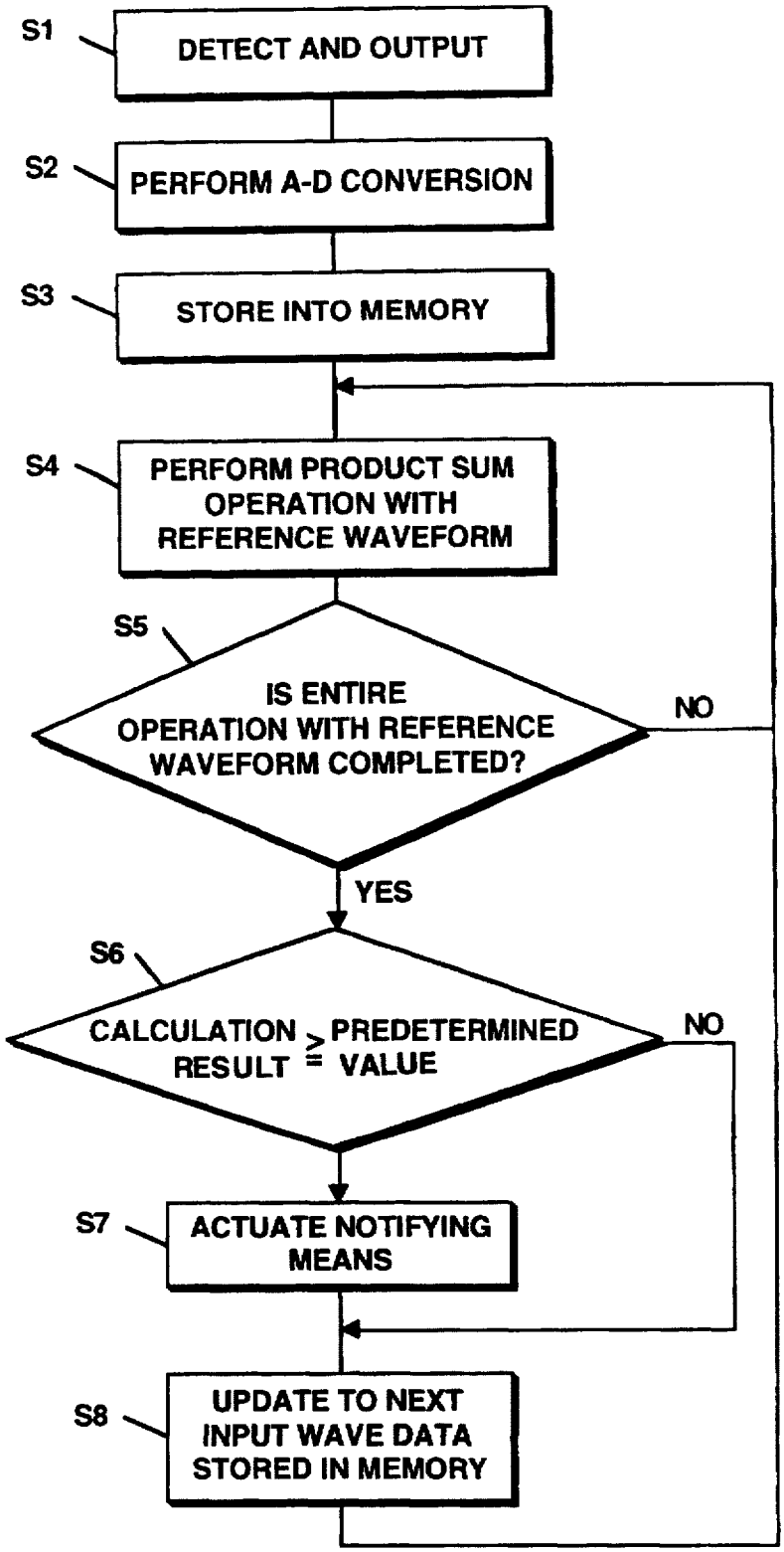
FIG. 2 is a flowchart illustrating the analysis processing.

The received signal is processed in accordance with the flowchart shown as an example in FIG. 2.

First, in S1, the received signal is sent through a matching circuit 8 and an amplifying portion 9 to a detection portion 10. The detection portion 10 performs synchronous detection using the signal inputted to the transmission antenna 1.

The following S2 passes it through a filter portion 11 (Although the embodiment uses a band-pass filter, it is possible to use other devices such as a low-pass filter or high-pass filter.) to remove signals not contained in the band of the re-radiated electromagnetic waves (electromagnetic waves radiated from the tag upon reception of electromagnetic waves from the transmission antenna), and then converts the signal into a digital signal by an A–D converting portion 12. S3 samples a waveform in every fixed length of time and stores it into a memory. Through S4 and the following steps, the waveform data thus stored are sequentially read one at a time, and sent to an analysis processing portion 13 as analysis means, and analyzed by the analysis processing portion 13.

A calculating portion 15 constituting the analysis processing portion 13 is provided with a memory circuit 15*a* in which a reference signal is stored as a model waveform of a resonance signal that is re-radiated from the resonance circuit 7*a* pre-disposed in the tag 7. The analysis processing portion 13 extracts a waveform that substantially conform to the model waveform of re-radiated electromagnetic waves pre-registered as a reference signal, from the signals received by the reception antenna 2, and then compares the waveform with a predetermined value.

The analysis processing will be described in detail. The extraction of a waveform substantially agreeing with the reference signal and the comparison of the waveform with the predetermined value are performed as follows. In S4, the calculating portion 15 equally divides the data of the reference signal and the sampled waveform data of the fixed length of time (FIG. 3*a*) into 1181 points with respect to the time axis, and picks up and stores the value at each point (FIG. 3*b*), and, although not shown in the drawings, multiplies the value of the registered reference signal at each of points 1–80 respectively by the value at each of points 1–80 in data corresponding to the aforementioned points 1–80 and calculates the sum of the products, and stores the calculation result (FIG. 4) into a memory, and then performs similar product sum operation by shifting the reference signal one point relative to the sampled data of the fixed length of time (FIG. 5*a*), and performs similar product sum operation by further shifting one point (FIG. 5*b*), and repeats this operation 1101 times, and stores each operation result into the memory.

When S5 confirms that the calculation processing for the 1101 combinations is completed, S6 collectively reads out the results stored in the memory. A detecting portion 16 compares the values of the calculation results with predetermined values L that are suitably determined, and detects a waveform where the calculated values are greater than the predetermined values L (FIG. 6).

If a waveform having calculated values greater than the predetermined values is detected, it is determined that a tag is present between the transmission and reception antennas. Then, S7 actuates notifying means 17 by a second computer 14.

If no waveform having calculated values greater than the predetermined values is detected, S8 reads other sampled received data. After data update, the analysis processing starting in S4 is repeatedly executed 1101 times.

It is also possible to perform the comparison with the predetermined values every time the product sum operation is performed by shifting the reference signal one point relative to the sampled data of one period.

The first computer 3 is designed to output a trigger signal to the second computer 14 and the calculating portion 15. Examples of the notifying means may be flickering of a lamp, alarming by a bell or a buzzer, door locking, or the like.

As described above, the analysis means multiplies the value of the reference signal at each point by the value at each point in the sampled data corresponding to the aforementioned point and calculates the sum of the products to emphasize only the resonance signal that conforms to the reference signal and, based on detection of an emphasized waveform, determine whether a tag is present. Therefore, even if S/N ratio is bad, the noise components will be reduced, so that the detection precision will drastically improve and the danger of detection errors will be eliminated.

The aforementioned predetermined values are determined on the basis of experimental values such that only resonance signals will be reliably discriminated. It is possible to provide a width of the range of the conformation between the resonance signal and the reference signal such that similar waveforms will also be detected.

Although the embodiment equally divides the reference signal data and the sampled signal into 80 points and 1181 points, respectively, the number of dividing points for the reference signal data and the sampled signal maybe determined to any numbers.

In addition, the transmission antenna and the reception antenna are not limited in configuration, size or frequency band used and the like to the embodiment. For example, the reception side may be crossed twice, or one of the antennas may be a type in which differently arranged antenna devices are used by alternating them. The analysis means and the notifying means may be suitably changed in accordance with the service conditions and, further, may be combined with other means or provided with functions other than the measures against noises.

Since the present invention extracts from the received signals only signals that substantially agree with the frequency of the model waveform pre-registered as a reference signal, and compares its waveform with a predetermined value, the present invention excludes all the signals of different waveforms and is able to pick up even a low-level resonance signal hidden in noises, thus achieving very high detection precision and performance.

Furthermore, if the signal analysis is performed by multiplying the value of a reference signal at each of points separately by the value of at each point in data corresponding to the aforementioned points, calculating the sum of the products and comparing the calculated value with a predetermined value for detection, the processing becomes quick and accurate. If the operation is repeatedly performed with a shift of one point at a time, detection will be made regarding all the signals contained in a sweep, so that even if the resonance frequency deviates due to variations with tags, detection omission will be eliminated. If a filter is used to remove signals not contained in the band of the re-radiated electromagnetic waves, the detection precision will be further improved.

I claim:

1. A theft checking system wherein a tag incorporating a resonance circuit is attached to a monitor object article, and if the tagged article passes between transmission and reception antennas disposed facing each other, the resonance circuit receives electromagnetic waves transmitted from the transmission antenna and undergoes resonance and re-radiates resonance electromagnetic waves, so that the reception antenna receives the resonance electromagnetic waves, thereby detecting passage of the tagged article, said theft checking system comprising analysis means for causing the transmission antenna to output electromagnetic waves of a constant amplitude in which a periodical sweep is made between predetermined frequencies, and for extracting a signal that substantially agrees with the period of a model waveform of a re-radiated electromagnetic waves pre-registered as a reference signal, from the signals received by the reception antenna, and for comparing its waveform with a predetermined value to recognize passage of the article;

the waveform that agrees with the reference signal is detected by sampling a waveform of a received signal in a fixed length of time, dividing the sampled waveform data of the fixed length of time, and registered reference signal respectively into portions by equal pitch with respect to the time axis, multiplying the value of the reference signal at each point separately by the data corresponding to that point, calculating the sum of the products, and comparing the calculated value with a predetermined value.

2. A theft checking system according to claim 1 wherein the comparison between the calculated value and the predetermined value is performed collectively with respect to results of repeated operations in which the reference signal is shifted one point at a time relative to the sampled waveform data of the fixed length of time.

3. A theft checking system according to claim 1 wherein the analysis means removes signals not contained in the band of the re-radiated electromagnetic waves from the received signals using a filter, and then performs A–D conversion and digital processing of the filtered signals.

4. A theft checking system according to claim 2 wherein the analysis means removes signals not contained in the band of the re-radiated electromagnetic waves from the received signals using a filter, and then performs A–D conversion and digital processing of the filtered signals.

* * * * *